US009574359B2

(12) United States Patent
Berset

(10) Patent No.: US 9,574,359 B2
(45) Date of Patent: Feb. 21, 2017

(54) ARRANGEMENT AND METHOD FOR REINFORCING SUPPORTING STRUCTURES

(71) Applicant: SIKA TECHNOLOGY AG, Baar (CH)

(72) Inventor: Thierry Berset, Winterthur (CH)

(73) Assignee: SIKA TECHNOLOGY AG, Baar (CH)

( * ) Notice: Subject to any disclaimer, the term of this patent is extended or adjusted under 35 U.S.C. 154(b) by 0 days.

(21) Appl. No.: 14/896,284

(22) PCT Filed: Jun. 6, 2014

(86) PCT No.: PCT/EP2014/061915

§ 371 (c)(1),
(2) Date: Dec. 4, 2015

(87) PCT Pub. No.: WO2014/195504

PCT Pub. Date: Dec. 11, 2014

(65) Prior Publication Data

US 2016/0138285 A1 May 19, 2016

(30) Foreign Application Priority Data

Jun. 6, 2013 (EP) ..... 13170879

(51) Int. Cl.
*E04G 23/02* (2006.01)
*E04C 5/07* (2006.01)

(52) U.S. Cl.
CPC ..... *E04G 23/0218* (2013.01); *E04C 5/07* (2013.01); *E04G 2023/0251* (2013.01); *E04G 2023/0262* (2013.01)

(58) Field of Classification Search
CPC ..... E04G 23/0218; E04G 2023/0251; E04G 2023/0262; E04G 23/02; E04C 5/07
See application file for complete search history.

(56) References Cited

U.S. PATENT DOCUMENTS 5,649,398 A * 7/1997 Isley, Jr. ..... E04C 5/07 24/304
5,937,606 A * 8/1999 Meier ..... E04G 23/0218 52/415

(Continued)

OTHER PUBLICATIONS

International Search Report (PCT/ISA/210) issued on Jul. 2, 2014, by the European Patent Office as the International Searching Authority for International Application No. PCT/EP2014/061915.

(Continued)

*Primary Examiner* — Beth Stephan
(74) *Attorney, Agent, or Firm* — Buchanan Ingersoll & Rooney PC

(57) ABSTRACT

The present disclosure relates to an arrangement having a supporting structure having a surface containing (e.g., consisting of) one or more faces, wherein a bore runs from at least one face into an inner region of the supporting structure, and this bore is filled with an adhesive and with a portion of a fibre bundle projecting beyond said face, wherein, on the at least one face, from which the bore runs into an inner region of the supporting structure, the supporting structure is provided with at least one groove which, starting from the bore, extends in at least one direction on the surface, and the projecting part of the fibre bundle is located, at least in part, in the at least one groove and is fastened therein by way of the adhesive.

19 Claims, 7 Drawing Sheets

(56) References Cited

U.S. PATENT DOCUMENTS

| | | | | |
|---|---|---|---|---|
| 6,324,805 | B1 | 12/2001 | Naniwa | |
| 6,511,727 | B1 * | 1/2003 | Bleibler | E04C 5/07 264/285 |
| 7,207,149 | B2 * | 4/2007 | Fyfe | E02D 27/42 156/73.2 |
| 7,574,840 | B1 | 8/2009 | Fyfe | |
| 7,930,863 | B1 | 4/2011 | Fyfe | |
| 7,946,088 | B1 * | 5/2011 | Fyfe | E04G 23/0218 52/309.13 |
| 2001/0047844 | A1 * | 12/2001 | Edwards | B29C 70/088 156/91 |
| 2005/0241260 | A1 * | 11/2005 | Wheatley | E04G 23/0218 52/719 |
| 2006/0059827 | A1 * | 3/2006 | Wheatley | E04G 23/0218 52/506.05 |
| 2009/0013625 | A1 * | 1/2009 | Tourneur | E04G 23/0218 52/223.13 |
| 2009/0044476 | A1 * | 2/2009 | Agneloni | E04G 23/0218 52/443 |
| 2011/0036029 | A1 * | 2/2011 | Tourneur | E04G 23/0218 52/309.1 |
| 2012/0110940 | A1 | 5/2012 | Hemphill | |
| 2014/0205800 | A1 * | 7/2014 | Raghavendran | E04G 23/0218 428/141 |

OTHER PUBLICATIONS

Written Opinion (PCT/ISA/237) issued on Jul. 2, 2014 by the European Patent Office as the International Searching Authority for International Application No. PCT/EP2014/061915.

Notification of Transmittal of Translation of the International Preliminary Report on Patentability (Forms PCT/IB/338 and PCT/IB/373) and the Written Opinion of the International Searching Authority (Form PCT/ISA/237) issued on Dec. 17, 2015, by the International Bureau of WIPO in corresponding International Application No. PCT/EP2014/061915. (10 pages).

* cited by examiner

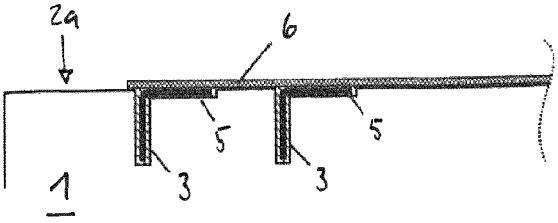
Fig. 3A
Fig. 3B
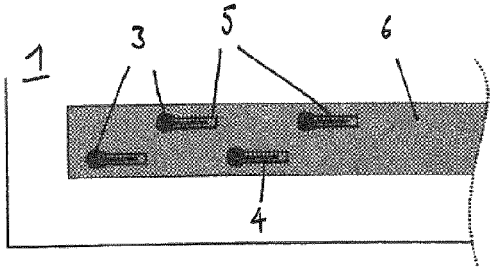
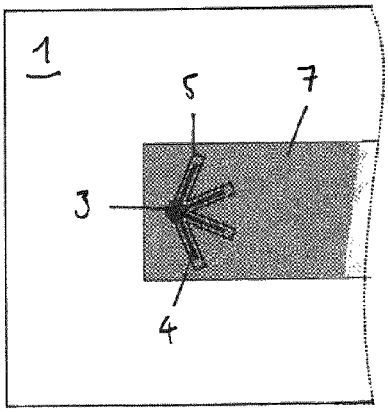
Fig. 3C
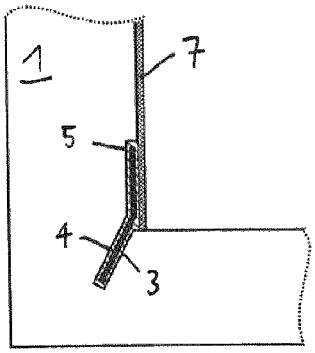
Fig. 3D
Fig. 3E
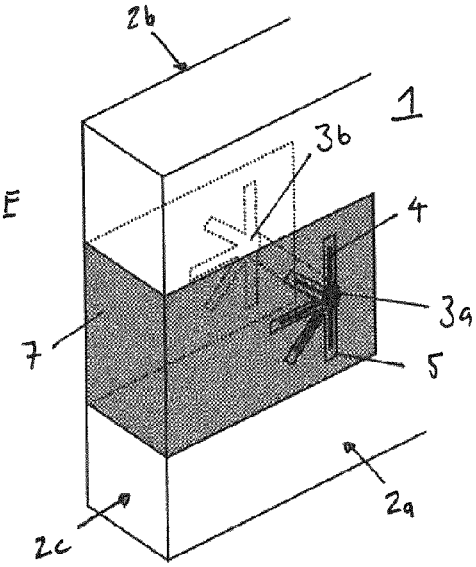

ARRANGEMENT AND METHOD FOR REINFORCING SUPPORTING STRUCTURES

TECHNICAL FIELD

The invention relates to the field of reinforcing supporting structures, preferably by attaching a surface reinforcement, in particular by introducing force into the surface reinforcement.

PRIOR ART

Methods for increasing the supporting resistance of existing supporting structures, typically reinforced concrete components, have already been used for many years. This often takes place by means of an additional reinforcement attached on the surface. Reinforcements which are predominantly adhesively bonded on the surface and are composed of fiber composite materials have become largely accepted here. The effectiveness of said surface reinforcement is normally limited by the maximum force which can be transmitted from the concrete to the reinforcement.

A very wide variety of methods for improving the transmission of force from the supporting structure to the surface reinforcement are known. A widespread method consists in introducing fiber bundles into a bore in the supporting structure and anchoring said fiber bundles there and in spreading or fanning out an end of the fiber bundle protruding over the surface and in adhesively bonding same on the surface. The surface reinforcement can subsequently then be adhesively bonded onto the reinforced supporting framework surface. Alternatively, the surface reinforcement can first of all also be adhesively bonded onto the supporting framework surface such that, when an anchor consisting of a fiber bundle is then attached, the protruding end of said fiber bundle is adhesively bonded onto the surface of the surface reinforcement. In the case of surface reinforcements having a plurality of layers, it is frequently recommended, for better transmission of force, to spread the anchor between the woven fabric layers.

The effectiveness of this measure has been demonstrated experimentally, but remains limited for various reasons.

Firstly, the potential area of fracture in the vicinity of the surface is pierced by each anchor only at one location (in the shaft). The resistance of said potential area of fracture is therefore increased only to a limited extent. Secondly, the transmission of force from those fibers of the fiber bundle which are spread on the surface to the fibers of the woven fabric is not optimum. The very thin fiber composite material formed on the surface by the fibers of the fiber bundle can be substantially loaded only in the tension direction. When subjected to a compressive load, the fiber composite material buckles, and when subjected to a shearing and bending load, only very low forces can be transmitted.

Therefore, only the fibers lying approximately in the tension direction of the surface reinforcement are completely effective. Said fibers make up only a small part of the cross section of the fiber bundle and cover only a small part of the width of the surface reinforcement.

A further disadvantage of the known method consists in that that end of the fiber bundle which protrudes over the surface is spread on the surface itself and therefore protrusions cause protruding deformations on the surface, which can firstly interfere with the visual appearance of a structure, but secondly may also cause technical disadvantages. For example, elevations in an otherwise flat surface may result in water, in particular rain water, or snow, and also dirt, accumulating at said elevations and impairing the long-term effect.

SUMMARY OF THE INVENTION

It is therefore the object of the present invention to provide an arrangement and a method, according to which the introduction of force into a surface reinforcement is intended to be improved.

It is furthermore the object of the present invention to improve the transmission of force by fiber bundles which are attached to a supporting framework, in particular into a surface region or into a region in the vicinity of the surface.

It has surprisingly been found that this object can be achieved by means of an arrangement as disclosed.

Accordingly, the essence of the invention is an arrangement comprising a supporting structure with a surface consisting of one or more faces, wherein a bore runs from at least one face into an inner region of the supporting structure, and said bore is filled with an adhesive and with a portion of a fiber bundle projecting beyond said bore, wherein, on the at least one face from which the bore runs into an inner region of the supporting structure, the supporting structure is provided with at least one groove which extends from the bore in at least one direction on the surface, and the projecting part of the fiber bundle is at least partially located in the at least one groove and is fastened therein with the adhesive.

An element or a part of an element which is exposed to forces is designated the supporting structure here. The supporting structure is typically a structure or a constituent part of a structure, for example a plate, a covering, a wall, a pillar, a rib, a beam or the like. The supporting structure is typically composed here of concrete, in particular of reinforced concrete, but may also be composed of bricks or other building stones, of wood, of steel or of other materials and also of any combinations of said materials. The structures are typically building construction and underground construction structures, such as houses, bridges, tunnels, barrages, sports installations, etc.

The fiber bundle is a loose arrangement of substantially uniformly directed individual fibers or filaments, in particular of carbon, glass, basalt, aramid, steel or other inorganic or organic materials. The fibers are preferably carbon fibers. The thickness of the fiber bundle is dependent on the region of use and on the forces which are intended to be transmitted by the fiber bundle. If the fiber bundle consists of carbon fibers, said fiber bundle comprises in particular 1,000 to 50,000 individual fibers which in each case themselves have a diameter within the range of 5 to 10 μm. A typical fiber bundle preferably has a cross-sectional area of 20 to 70 $mm^2$, in particular of 25 to 40 $mm^2$.

The fiber bundle is attached to the supporting structure typically by a bore which serves for receiving a portion of the fiber bundle being provided, in a first step, at the desired location. The bore can be provided here using any means, wherein such means are very well known to a person skilled in the art. The dimensions of the bore arise from the thickness and the length of the fiber bundle and the thickness and length arise in turn from the requirements imposed on the arrangement according to the invention. A suitable bore typically has a diameter of 1 to 5 cm, in particular of 1.5 to 3 cm, and a depth of 5 to 30 cm, in particular of 7 to 20 cm.

In a further step, one or more grooves are provided starting from the bore or from the entry point of the bore into the surface of the supporting structure. The grooves can also be provided using any means, for example using an angle grinder.

The groove or the grooves is or are dimensioned here in such a manner that said grooves, in the entirety thereof, can receive the fiber bundle which, in the event of a plurality of grooves being present, can be divided up into individual fiber strands. The number and arrangement of the grooves is dependent here on the region of use of the arrangement according to the invention.

After the bore and the at least one groove are provided, the fiber bundle is inserted into bore and groove and adhesively bonded therein. For this purpose, first of all an adhesive is placed into the bore and into the at least one groove. The fiber bundle, which has been impregnated previously preferably with a resin, is then placed into the bore in such a manner that a portion of the fiber bundle projects beyond the bore. During the course of attaching the arrangement according to the invention to a supporting framework, that portion of the fiber bundle which projects beyond the bore generally also projects beyond the surface of the supporting structure. That portion of the fiber bundle which, however, is located in a groove in the mounted arrangement then no longer projects beyond the surface of the supporting structure, as a result of which a uniform and smooth surface can be ensured.

Said projecting portion of the fiber bundle is at least partially inserted into the groove provided with adhesive, or is uniformly divided up into a number of fiber strands corresponding to the number of grooves and inserted into the grooves. The entire fiber bundle or all of the fiber strands is or are generally preferably inserted into one or more grooves such that the fiber bundle does not project beyond the surface of the supporting structure at any point. After the fiber bundle is inserted into the at least one groove, the fiber bundle can be held down therein. Adhesive running out of the drill hole or out of the groove is subsequently removed or is distributed uniformly in the region of the surface affected by the arrangement. If, after the fiber bundle is inserted, there are still cavities in the bore or in the at least one groove, said cavities can be filled with adhesive.

The introduction of the fiber bundle into the bore takes place in particular with a needle-like object. For better guidance with the needle-like object, a clamp, a cable connector or the like, on which the needle-like object can be hooked, can be attached to the fiber bundle.

The impregnation of the fiber bundle with a resin before being inserted into bore and groove has the advantage that the entire fiber bundle can be wetted with resin, even in the inner region. In order to ensure optimum adhesion between fiber bundle and supporting structure, the resin for the impregnation of the fiber bundle has in particular the same chemical basis as the adhesive for fastening the fiber bundle in bore and groove. In particular, both the resin and the adhesive are epoxy resin compositions. It is possible for the adhesive and the resin to be the same composition, wherein, in the case of the resin, the viscosity is typically set somewhat lower than in the case of the adhesive, which, in turn, serves for better wetting of the fibers.

Both in the case of the adhesive for fastening the fiber bundle into bore and groove and in the case of the resin for the possible impregnation of the fiber bundle, use is preferably made of a two-pack epoxy resin composition. Suitable epoxy resin compositions are commercially available from Sika Schweiz AG, for example under the trade name Sikadur®.

The adhesive bonding points on the supporting structure are preferably clean, dry and free from dust and grease. Suitable cleaning measures or preliminary treatments may be used depending on the materials of which the supporting structure is composed.

The arrangement according to the invention can be attached to a supporting structure for different purposes. In particular, the arrangement itself serves as a reinforcement for the supporting structure and/or serves as an anchor or as an anchorage for a surface reinforcement attached to the supporting structure.

If the arrangement serves as an anchorage for a surface reinforcement attached to the supporting structure, said arrangement preferably has a plurality of grooves which extend along the surface from the bore. In this case, the number of grooves per bore is preferably 2 to 16, in particular 6 to 10. The grooves are arranged here in particular in a circular manner and at regular intervals around the bore. In particular, the grooves are arranged in a circular sector around the bore, wherein the circular sector preferably has a center point angle of 60 to 360°. The arrangement of the grooves is generally aligned in accordance with the load direction of the surface reinforcement which is adhesively bonded via the arrangement according to the invention to the supporting structure as an anchor or anchorage. In particular, the grooves in this case spread out in the tension direction of the surface reinforcement.

In a further embodiment, the arrangement itself can serve for reinforcing a supporting structure. In this case, in particular, a plurality of the described arrangements are attached at regular intervals to a supporting structure. Also in this case, the arrangement according to the invention can have a plurality of grooves, as described previously. The arrangement in this case preferably has a second bore which runs into an inner region of the supporting structure, wherein the second bore can be located on the same face or on another face of the surface. The at least one groove runs here from the inlet location of the one bore, i.e. the first bore, along the surface of the supporting structure toward the inlet location of the second bore; the two bores are therefore connected to each other in the surface region of the supporting structure via the at least one groove.

If the two bores are not located on the same face of the surface of the supporting structure, i.e. if, for example, one or more edges or corners are therefore located between the faces, the at least one groove also runs over said edges or corners.

If the two bores are located on mutually averted faces of a supporting structure, it is possible for the two bores to be connected to each other in the extension of the respective bore axes thereof.

For example, this is the case if the arrangement according to the invention is intended to be attached in the region of the end side of a wall which is free-standing at least on one side. In this case, the two bores can be provided by the wall being bored through at one point. A groove is then provided in particular in such a manner that said groove connects the inlet location and the outlet location of the bore in the wall to each other beyond the end side. The outlet location of the one bore in the wall constitutes the inlet location of the second bore.

Also in the case of such a use of the arrangement according to the invention, a surface reinforcement can be attached to the surface of the supporting structure.

Irrespective of the structure of the arrangement according to the invention, the surface reinforcement is preferably attached in such a manner that said surface reinforcement covers that portion of the fiber bundle which runs on the surface of the supporting structure in at least one groove and the bore or the inlet location of the bore into the surface as a whole and is adhesively bonded over said entire region to the surface of the supporting structure.

Lamellas or woven fabrics which run along the surface of a supporting structure and are adhesively bonded thereto, in particular over the full surface area, are particularly suitable as the surface reinforcement. Suitable lamellas include in particular uni-directionally fiber-reinforced plastics flat ribbon lamellas. The fiber reinforcement customarily takes place by means of carbon fibers, but, as in the case of the fiber bundle, can also take place by means of glass, basalt or aramid. In particular, an epoxy resin matrix serves as the plastics matrix. Equally suitably, a plastics matrix can be based on polyurethane, vinyl esters, polyacrylate or other compositions which have structural properties. Suitable fiber-reinforced plastics flat ribbon lamellas are commercially available from Sika Schweiz AG, for example under the trade name Sika® CarboDur®.

An, in particular uni-directional, carbon fiber woven fabric is preferably suitable as the woven fabric, wherein said woven fabric can also be composed of glass fibers, basalt fibers or aramid fibers. In contrast to the fiber-reinforced plastics flat ribbon lamellas, the woven fabric is typically not applied to the surface already in a cured plastics matrix, but rather is provided with a curable composition before or after attachment to the surface. The curable composition is in particular an epoxy resin composition, wherein polyurethane or polyacrylate could also be used here.

A suitable woven fabric is in particular a carbon fiber woven fabric, as is commercially available from Sika Schweiz AG, for example under the designation SikaWrap®.

Preferably, two-pack epoxy resin compositions, as are commercially available from Sika Schweiz AG, for example under the trade name Sikadur®, are used both as the plastics matrix for the fiber-reinforced plastics flat ribbon lamellas and for the adhesive bonding of said plastics matrix or of the woven fabric to the supporting structure.

As already described previously, it is possible for the fiber bundle to run in the at least one groove over edges and/or corners which connect different faces of the surface of the supporting structure to one another. If an edge is involved here, said edge preferably has a rounded portion in the interior of the groove. The radius of the rounded portion is in particular approximately 0.5 to 10 cm, in particular 1 to 5 cm.

The rounded portion of the edge protects the fiber bundle which is placed into bore and groove, as a result of which fewer breakages of the fibers occur and an improved transmission of force is possible. Irrespective of the respective embodiment of the present invention, all edges of the supporting structure over which a groove with fiber bundle is intended to run are generally preferably rounded within the groove.

Furthermore, it is also possible for the transition from the bore into the groove also to have a rounded portion in accordance with the preceding description.

The arrangement according to the invention and a method for application thereof are typically used in the reinforcement of existing supporting structures, for example in the case of renovation, repair or in the case of earthquake reinforcement attached retrospectively to supporting structures. If the supporting structure is a reinforced concrete structure, the reinforcement takes place, for example, wherever the steel reinforcement is inadequate or where the latter has incurred damage due to an unforeseen event.

A method according to the invention for reinforcing a supporting structure with a surface consisting of one or more faces accordingly comprises the following steps:

- providing at least one bore from a face of the supporting structure into an inner region of the supporting structure,
- providing at least one groove from the bore in at least one direction on the surface of the supporting structure,
- placing an adhesive into the at least one bore,
- introducing a fiber bundle into the bore such that a portion of the fiber bundle projects beyond the bore,
- at least partially inserting the projecting portion of the fiber bundle into the at least one groove,
- fastening the projecting portion of the fiber bundle in the groove by means of adhesive.

According to the preceding description of the arrangement according to the invention, the method may comprise further steps. In particular, the fiber bundle is impregnated with a resin before being introduced into the bore and inserted into the at least one groove.

If a surface reinforcement is provided on the supporting structure, the method furthermore comprises a step of attaching a surface reinforcement to the surface of the supporting structure, wherein a surface reinforcement, in particular a lamella or a woven fabric, is attached over that portion of the fiber bundle which has been fastened in the groove by means of adhesive and is adhesively bonded to the surface of the supporting framework at least in the region of that portion of the fiber bundle which has been fastened in the groove by means of adhesive.

BRIEF DESCRIPTION OF THE DRAWINGS

Exemplary embodiments of the invention are explained in more detail with reference to the drawings. Identical elements are provided with the same reference signs in the various figures. Of course, the invention is not limited to exemplary embodiments which are shown and described.

In the drawings.

Only the elements essential for direct comprehension of the invention are shown in the figures.

WAYS OF IMPLEMENTING THE INVENTION

Figure 1A:
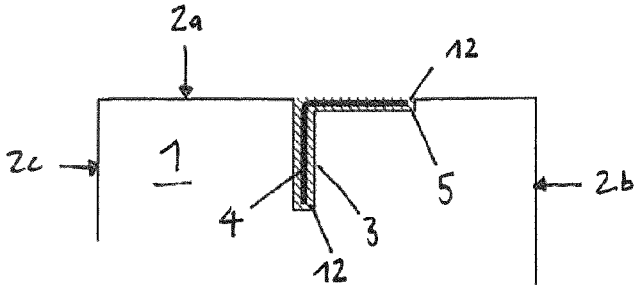
FIGS. 1A to 2C show: supporting structures with bores and grooves and fiber bundles or fiber strands adhesively bonded therein.
Figure 1B:
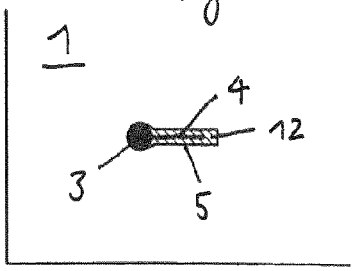

FIG. 1A shows a section through a supporting structure 1 with a surface consisting of a plurality of faces 2*a*, 2*b*, 2*c*, wherein a bore 3 runs from the face 2*a* into an inner region of the supporting structure. Said bore is filled with an adhesive 12 and with a portion of a fiber bundle 4 projecting beyond said bore. On the face 2*a*, the supporting structure 1 is provided with a groove 5 which extends from the bore 3 or the inlet location of the bore into the face in one direction on the surface. That part of the fiber bundle 4 which projects beyond the bore is located in the groove 5 and is fastened therein with adhesive 12. FIG. 1B shows a top view of the arrangement shown in FIG. 1A, wherein a single groove 5 runs from the bore 3 in one direction on the surface. Furthermore, the entire projecting part of the fiber bundle is located in the groove and is fastened therein with adhesive 12.

Figure 1C:
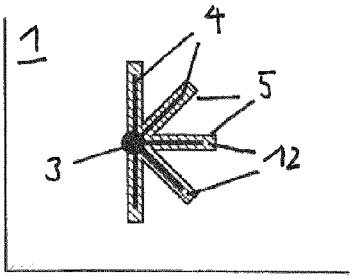

FIG. 1C likewise shows a top view of the arrangement shown in FIG. 1A, wherein, in this embodiment, a plurality of grooves 5 run from the bore 3 in various directions on the surface. The projecting part of the fiber bundle 4 is divided up according to fiber strands, wherein said fiber strands preferably have approximately the same thickness, and the fiber strands are located in the grooves and are fastened therein with adhesive 12.

Figure 2A:
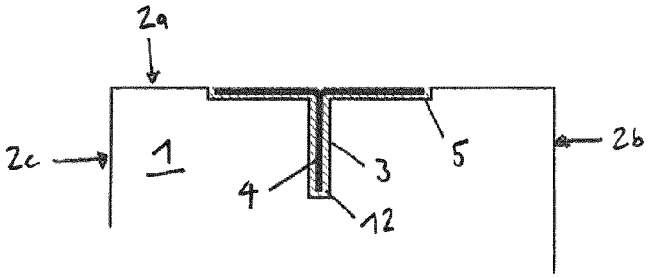
Figure 2B:
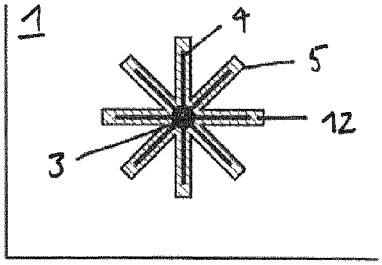

FIGS. 2A and 2B essentially show an analogous embodiment to the one shown in FIGS. 1A and 1C, wherein the plurality of grooves 5 run from the bore 3 radially on the surface of the supporting structure 1.

Irrespective of the above-described embodiments, that portion of the fiber bundle which is located in the bore constitutes in particular one of the two loose ends of the fiber bundle. The other loose end of the fiber bundle constitutes that part of the fiber bundle which projects beyond the bore or which is located in the groove or the grooves and is fastened there.

In another, less preferred embodiment, it is also possible to fold over a fiber bundle, in particular in the region of the center thereof or geometric center of gravity thereof, and thus to place the two loose ends of the fiber bundle one above the other. The fiber bundle is then introduced into the bore, preferably by the folded end, and the two loose ends are placed into the groove or divided up between a plurality of grooves. In both cases, that portion of the fiber bundle which is located in the bore is in each case in particular approximately the same length as that portion which projects beyond the bore.

Figure 2C:
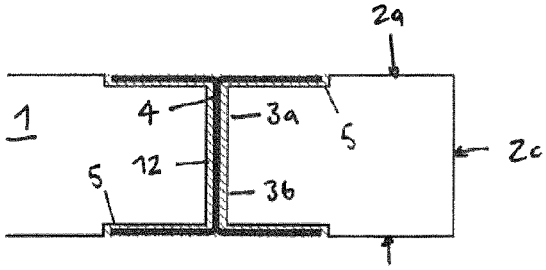

FIG. 2C shows an embodiment of the invention in which a central portion of the fiber bundle is located in the bore. The supporting structure 1 shown here has a surface consisting of a plurality of faces 2*a*, 2*b*, 2*c*, etc., and a first bore 3*a* which runs from the face 2*a* into the inner region of the supporting structure. The second bore 3*b* runs from the face 2*b* into the inner region of the supporting structure. The face 2*b* faces away from the face 2*a*, and the two bores 3*a* and 3*b* are arranged in such a manner that they are connected to each other in the extension of the respective bore axes thereof. Of course, in the case shown, the two bores can be provided by the supporting structure being bored through from one face and the second bore therefore constituting the outlet point of the first bore. The bores 3*a* and 3*b* are filled with an adhesive 12 and with a portion of a fiber bundle 4. In particular, in this embodiment, a fiber bundle is arranged in the bore in such a manner that the central portion thereof is located in the bore and that the loose ends thereof each protrude beyond the surface of the supporting structure. A plurality of grooves 5 run in each case from the bores 3*a* and 3*b* in various directions on the surface, for example in the manner as illustrated in FIG. 2B. The projecting parts of the fiber bundle 4 are divided up according to fiber strands, and the fiber strands are located in the grooves and are fastened therein with adhesive.

FIGS. 3A (cross section) and 3B (top view) show a possible embodiment of the arrangement according to the invention. In this case, a face 2*a* of the surface of a supporting structure 1 has a plurality of bores 3 which run into the inner region of the supporting structure 1, and, in each case per bore, a single groove 5 which extends along the surface (cf. also FIG. 1B). The bores 3 and the grooves 5 are offset with respect to one another, but are provided in the entirety thereof linearly on the surface. A lamella 6 as a surface reinforcement is attached over the grooves 5 with the portions of the fiber bundles 4, wherein said lamella is adhesively bonded at least in this region to the surface of the supporting structure. In particular, a lamella of this type is adhesively bonded to the surface of the supporting structure over the entire surface area.

Arrangements as are shown in FIGS. 3A and 3B occur in particular in the region of the end portions, for example in the final 0.5 to 1 meter, of the lamellas and serve for improved transmission of force between supporting structure and lamella, that is to say for surface reinforcement.

FIG. 3C shows a top view of an arrangement which substantially corresponds to that from FIG. 1C, wherein a woven fabric 7 is attached as a surface reinforcement over the grooves 5, which emerge from the bore 3 and are provided with fiber strands of the fiber bundle 4 and with adhesive. Such a woven fabric is also adhesively bonded to the surface of the supporting structure preferably over the entire surface area. The bonding over the area of the fiber bundle which is adhesively bonded into the grooves leads to an improved transmission of force between supporting structure and woven fabric, i.e. to surface reinforcement.

An embodiment of the arrangement according to the invention as shown in FIGS. 1C and 3C is furthermore illustrated in FIG. 3D. In this case, the bore 3 which runs into the inner region of the supporting structure is located at a junction between two sheet-like elements of a supporting structure, for example at a junction between two walls or between wall and floor plate. Also in this case, a surface reinforcement in the form of a woven fabric 7 is attached via the anchor region.

A further embodiment of the invention is shown in FIG. 3E. The supporting structure 1 shown here has a surface consisting of a plurality of faces 2*a*, 2*b*, 2*c*, and a first bore 3*a* which runs from the face 2*a* into the inner region of the supporting structure. The second bore 3*b* runs from the face 2*b* into the inner region of the supporting structure. The face 2*b* faces away from the face 2*a*, and the two bores 3*a* and 3*b* are arranged in such a manner that they are connected to each other in the extension of the respective bore axes thereof. Of course, in the case shown, the two bores can be provided by the supporting structure being bored through from one face and the second bore therefore constituting the outlet point of the first bore. The bores 3*a* and 3*b* are filled with an adhesive (not illustrated) and with a portion of a fiber bundle 4. In particular, in this embodiment, a fiber bundle is arranged in the bore in such a manner that the central portion thereof is located in the bore and that the loose ends thereof each protrude over the surface of the supporting structure. A plurality of grooves 5 run in each case from the bores 3*a* and 3*b* in various directions on the surface. The projecting parts of the fiber bundle 4 are divided up according to fiber strands, and the fiber strands are located in the grooves and are fastened therein with adhesive. A woven fabric 7 which runs over the end side of the supporting structure and is adhesively bonded to the supporting structure in a manner running in the region of the grooves from the inlet point of the bore 3*a* toward that of bore 3*b*, is attached over the arrangements described.

Figure 3F:
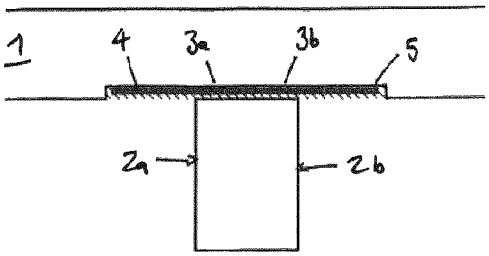
FIGS. 3A to 4B show: supporting structures with bores and grooves and fiber bundles or fiber strands adhesively bonded therein, and also a surface reinforcement.

An embodiment of the present invention, in which there are also two bores which are connected to each other in the extension of the bore axes thereof is illustrated in FIGS. 3F (cross section) and 3G (top view). A T-shaped supporting structure here with a surface comprising a plurality of faces 2*a*, 2*b*, etc., has, at the junction between the two sheet-like elements thereof, two bores 3*a* and 3*b* which connect the faces 2*a* and 2*b* to each other. The fiber bundle 4 is arranged in the bore in such a manner that the central portion thereof is located in the bore and that the loose ends thereof each protrude over the surface of the supporting structure. A plurality of grooves 5 run in each case from the bores in various directions on the surface. The projecting parts of the fiber bundle 4 are divided up according to fiber strands, and the fiber strands are located in the grooves and are fastened therein with adhesive.

Figure 3G:
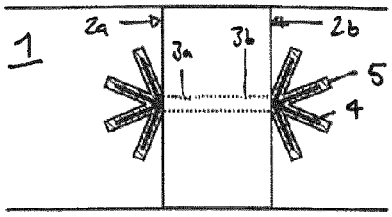
Figure 3H:
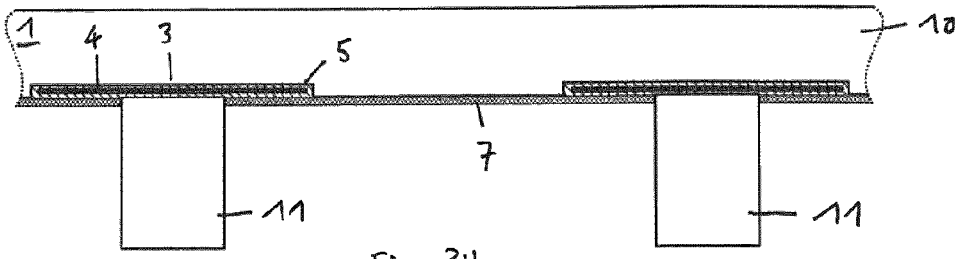
Figure 3I:
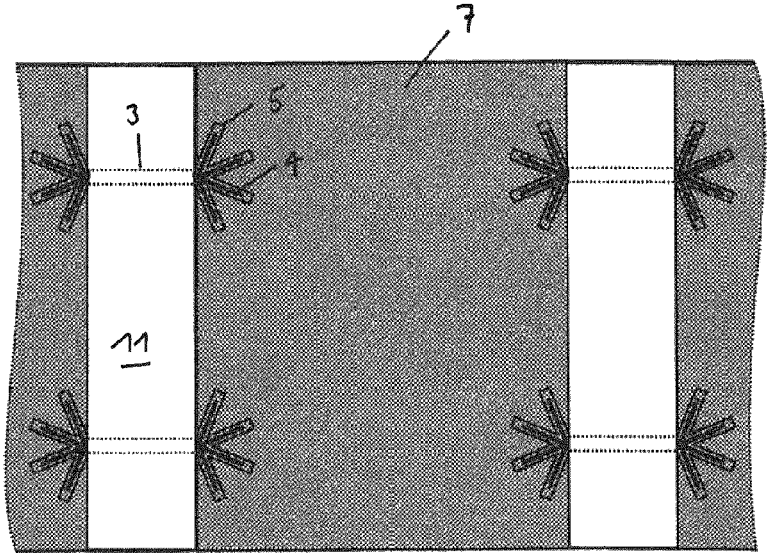

One possible application of the arrangement shown in FIGS. 3F and 3G is shown in FIGS. 3H and 31. The supporting structure 1 here is a concrete slab 10 which has a plurality of reinforcing ribs 11, i.e. T-shaped portions. The reinforcing ribs 11 have bores 3 in the region of the junctions thereof with the concrete slab 10, wherein said bores are positioned in such a manner that in each case two bores are connected to each other in the extension of the bore axes thereof. A plurality of grooves run from the inlet point of the respective drill hole 3 along the surface of the concrete slab. Analogously to the above-described embodiments, drill holes and grooves are filled with a fiber bundle or with fiber strands of the fiber bundle, and adhesive. A surface reinforcement in the form of a woven fabric 7 is attached over the surfaces of the concrete slab, which surfaces are located between the reinforcing ribs 11. Said woven fabric is adhesively bonded to the surface located therebelow, in particular over the entire surface area.

Figure 4A:
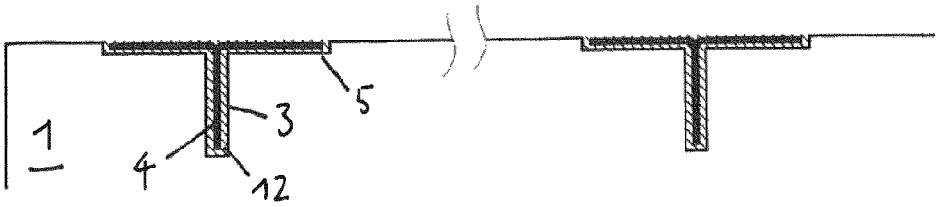
Figure 4B:
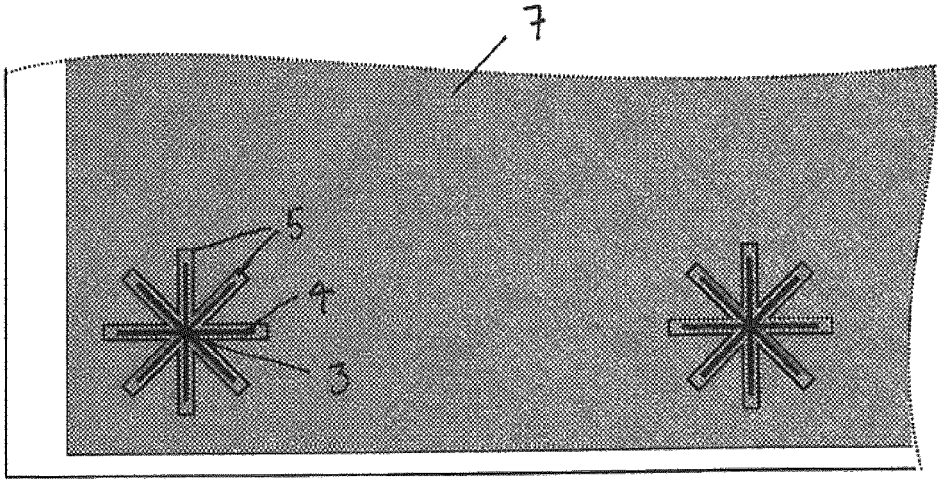

FIGS. 4A (cross section) and 4B (top view) show a further embodiment of the invention, in which arrangements, as are shown, for example, in FIGS. 2A and 2B, are attached at regular distances to a supporting structure 1. The arrangements can be attached here on one face of the surface of the supporting structure or on a plurality of faces. Furthermore, a woven fabric 7 is adhesively bonded over the arrangements at least to the arrangements, but in particular over the full surface area to the surface of the supporting structure. The woven fabric can run here continuously over corners and edges in the surface of the supporting structure.

Figure 5A:
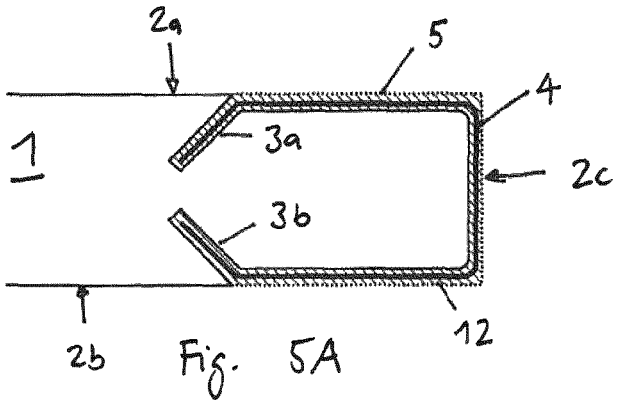
FIGS. 5A to 6F show: embodiments of supporting structures with bores and grooves and fiber bundles or fiber strands adhesively bonded therein.

FIG. 5A shows a section through an embodiment of a supporting structure 1 with a surface consisting of a plurality of faces 2*a*, 2*b*, 2*c*, etc., and a first bore 3*a* which runs from the face 2*a* into the inner region of the supporting structure. The second bore 3*b* runs from the face 2*b* into the inner region of the supporting structure. The face 2*b* faces away from the face 2*a*. A groove 5 runs from the one bore 3*a* along the surface of the supporting structure toward the inlet location of the other bore into the supporting structure. The groove which therefore connects the two inlet holes of the bores to each other runs in particular on the shortest route between the two bores. However, depending on requirements imposed on the reinforcement of the supporting structure, it is also conceivable for the groove to adopt a different profile between the bores, for example in order to ensure as uniform as possible a distribution of force. A fiber bundle 4 which leads with the loose ends thereof into the two bores 3*a* and 3*b* runs in the groove 5. Adhesive 12 for the fastening of the fiber bundle is located both in the bores and in the groove.

Figure 5B:
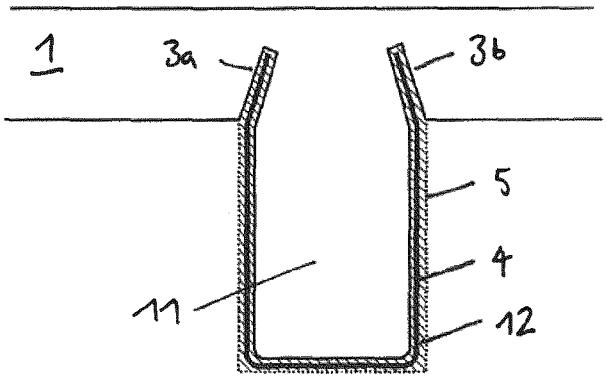

A similar embodiment as in FIG. 5A is also illustrated in FIG. 5B, wherein the fiber bundle here helically reinforces a reinforcing rib 11 of a supporting framework 1.

Figure 6A:
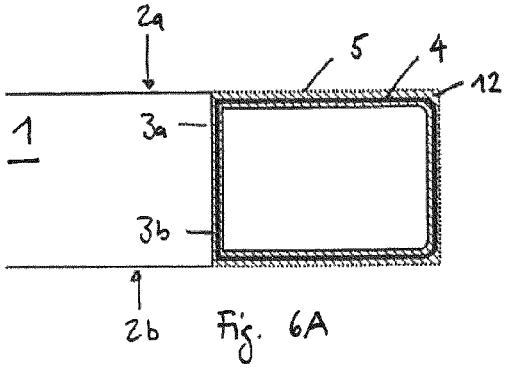

FIG. 6A shows a section through a further embodiment of the invention, which embodiment corresponds to a modification of the embodiment from FIG. 5A. In contrast thereto, the embodiment in FIG. 6A has two bores 3*a*, 3*b* in different mutually averted faces 2*a*, 2*b* of the surface of the supporting structure, wherein the two bores 3*a* and 3*b* are arranged in such a manner that they are connected to each other in the extension of the respective bore axes thereof. The inlet holes of the two bores 3*a* and 3*b* are connected to each other via a groove 5 as in FIG. 5A. Both the bores 3*a*, 3*b* and the groove 5 contain an adhesive 12 and a fiber bundle 4. The fiber bundle is arranged here in particular in such a manner that the two ends thereof overlap. Said overlap can be located in the bore or at any location in the groove. The length of the overlapping region of the fiber bundle is selected here in particular in such a manner that as gap-free a transmission of force as possible is ensured, and is approximately 5 to 50 cm. Depending on the requirements imposed on the supporting structure, it is also possible to repeatedly wind the fiber bundle around the supporting structure.

In general and in particular also with regard to the embodiments of the invention, as are shown in FIGS. 5A and 5B and in FIGS. 6A to 6D, those embodiments are preferred in which the two bores 3*a* and 3*b* are arranged in such a manner that they are connected to each other in the extension of the respective bore axes thereof, and the fiber bundle is arranged in such a manner that the two ends thereof at least overlap. The fiber bundle thereby forms a closed loop, as a result of which the transmission of the shearing forces takes place between the two ends of the fiber bundle, i.e. in a critical manner in terms of contact within the same material. In comparison to embodiments in which the ends of the fiber bundle are inserted into separate bores and the transmission of the shearing force therefore takes place between the supporting structure and the fiber bundle, i.e. in a manner critical for the bond, the preferred embodiments permit greater efficiency of the reinforcement and a significantly better utilization of the fiber bundle.

Figure 6B:
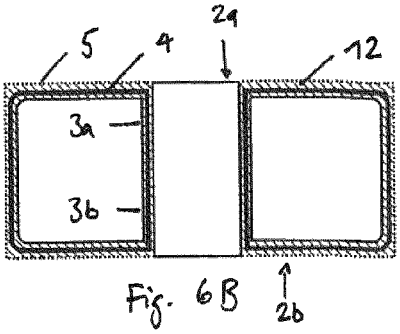
Figure 6C:
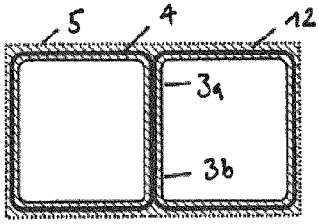

FIGS. 6B and 6C show modifications of the embodiment as described in FIG. 6A. Arrangements according to the invention as can be used, for example, for reinforcing a rectangular pillar as a constituent part of a supporting structure are shown here. FIG. 6C shows here that it is also possible for the fiber bundle 4 to be guided repeatedly through a bore, but to run in two different grooves from the inlet location of the first bore to that of the second bore. Secondly, the embodiment from FIG. 6C can also be provided by that part of the fiber bundle which projects beyond the bore being divided up into two fiber strands which then run in different grooves.

Figure 6E:
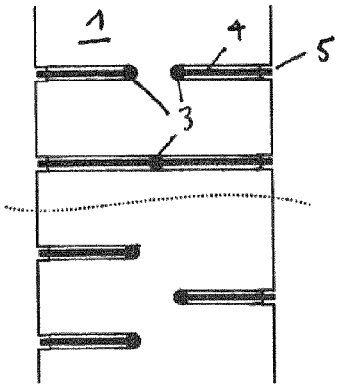
Figure 6D:
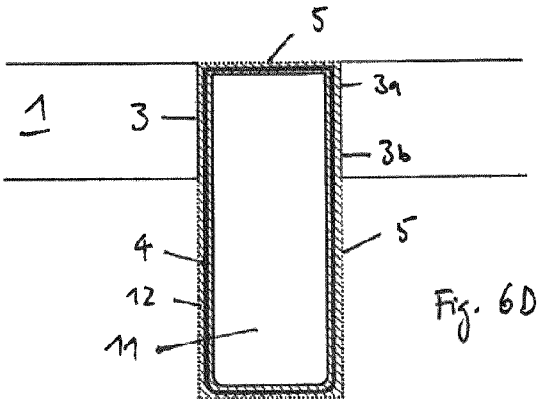

FIG. 6D shows a modification of the embodiment as illustrated in FIG. 5B, wherein the fiber bundle 4 here helically reinforces the reinforcing rib 11 completely.

FIG. 6E shows a side view of a supporting structure which comprises the variants of the arrangement according to the invention that are illustrated in FIGS. 6A, 6B and 6C. Depending on requirements, the various variants can be combined with one another, or a plurality of identical arrangements are attached throughout to a supporting structure.

Figure 6F:
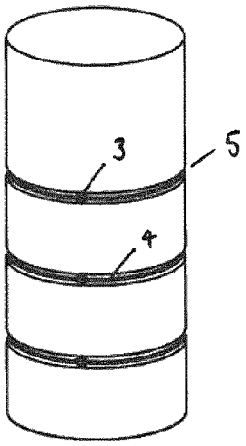
Figure 6G:
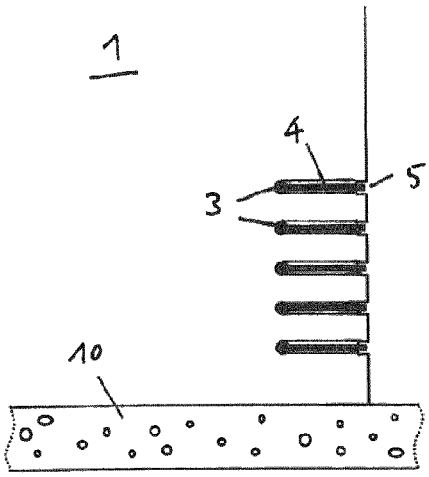

FIG. 6G shows a supporting structure 1 comprising a base plate 10 and a wall provided on the latter, wherein the wall is provided in the lower region thereof with a plurality of arrangements according to the invention which correspond to those from FIG. 6A. A woven fabric can optionally also be attached over said arrangements to additionally reinforce the supporting structure (not illustrated here).

FIG. 6F shows a cylindrical pillar which comprises a plurality of arrangements according to the invention.

Figure 7A:
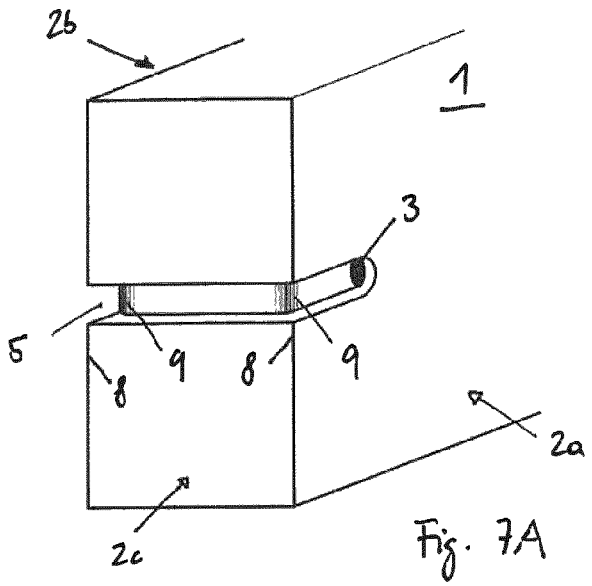
FIGS. 7A and 7B show: detailed views of supporting structures with rounded edges within the groove.

FIG. 7A shows a detailed view of a detail of a supporting structure 1 with a surface consisting of a plurality of faces 2*a*, 2*b*, 2*c*, wherein a bore 3 runs from a face 2*a* into an inner region of the supporting structure. On the face 2*a*, from which the bore runs into an inner region of the supporting structure, the supporting structure 1 is provided with a groove 5 which extends from the bore in one direction on the surface.

The groove 5 runs here over a respective edge 8 which connects the two faces 2*a* and 2*c* or 2*c* and 2*b* of the surface of the supporting framework to each other, and said one edge 8 has a rounded portion 9 in the interior of the groove 5.

Figure 7B:
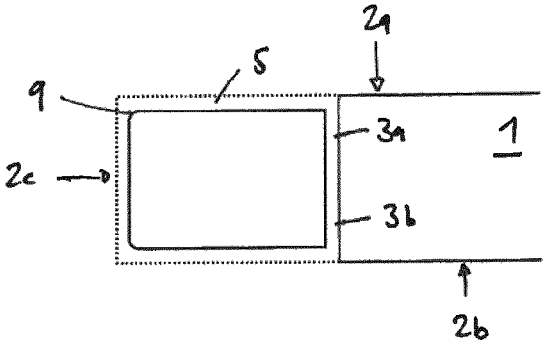

FIG. 7B shows a section through a region of a supporting structure 1 that has two bores 3*a*, 3*c* in different mutually averted faces 2*a*, 2*c* of the surface of the supporting structure, wherein the two bores 3*a* and 3*c* are arranged in such a manner that they are connected to each other in the extension of the respective bore axes thereof. The inlet holes of the two bores 3*a* and 3*b* are connected to each other via a groove 5. The edges 8 within the groove 5 each have a rounded portion 9. The respective transitions from the bore into the groove can also have a rounded portion here in accordance with the preceding description.

EXAMPLES

Exemplary embodiments which will explain the described invention in more detail are cited below. Of course, the invention is not limited to these described exemplary embodiments.

Test Pieces

Concrete cubes with an edge length of 20 cm were produced as test pieces, wherein concrete from the same batch was used for all the cubes. The concrete cubes were stored for 28 days at 23° C. and 50% relative air humidity. The concrete cubes were ground on one side in order to free them from cement slurry. A bore with a diameter of 20 mm and a depth of 100 mm was provided in the center of the treated face. Two concrete cubes were left without a bore. Starting from the bore 8 grooves were provided in each case uniformly around the bore in the concrete cubes with an angle grinder. The grooves had a width of 5 mm and a depth of 5 mm and extended over a length of 8 cm. The angle between the grooves was in each case 45°. In the case of four concrete cubes, only five grooves were in each case provided in a semicircular manner. The edges at the transition from the bore into the grooves were slightly rounded. No grooves were provided in the case of two cubes. The concrete cubes were subsequently repeatedly cleaned on the machined surface and in the interior of the bore with compressed air and a brush and thus substantially freed from dust.

Sikadur®-330, commercially available from Sika Schweiz AG, was applied to the machined surface of the concrete cubes without the bore with an average layer thickness of approx. 1 mm by means of a notched trowel. In the case of the concrete cubes with a bore, the bore was filled from below upward, and also the grooves were filled with Sikadur®-330. Care had to be taken here to ensure that no air remained enclosed in the bore.

A fiber bundle of a length of 20 cm and a fiber cross-sectional area of approximately 25 $mm^2$ was completely impregnated with Sikadur® 300 from Sika Schweiz AG with the aid of a paint brush. Subsequently, a cable connector was attached to a loose end of the impregnated fiber bundle and firmly tightened and cut to size. With the aid of a knitting needle which was hooked onto the cable binder, the fiber bundle was introduced into the bore as far as the stop. The protruding end of the fiber bundle was divided up into fiber strands, wherein the number of fiber strands had to correspond to that of the previously provided grooves, and the fiber strands were placed into the grooves. In the case of the concrete cubes without grooves, the protruding end of the fiber bundle was uniformly fanned out and spread over the machined surface of the concrete cube.

On the machined surface of the concrete cube, Sikadur®-330 was then distributed uniformly over the grooves with the fiber bundle, and therefore the entire machined surface was covered with sufficient adhesive.

A prepared woven fabric composed of SikaWrap® 300 C NW (width 20 cm, length 180 cm) was laminated in the region of the final 20 cm of the loose ends thereof with Sikadur®-300 by means of a paint roller. A laminated loose end was placed onto the machined face of the concrete cube and pressed on there with a paint roller. Sikadur®-330 was applied over the attached woven fabric by means of a notched trowel. The woven fabric was folded in a loop, and the other loose and laminated end was placed onto the same location of the concrete cube such that the two ends of the woven fabric came to lie one above the other. The woven fabric was pressed on in turn with the paint roller. Excess adhesive was removed from the test piece with a spatula of the width of the concrete cube.

The test pieces produced in such a manner were left for 7 days at 23° C. and 50% relative air humidity so that the adhesive could cure. Test pieces with fiber bundles made from glass fibers with a fiber cross-sectional area of approximately 25 $mm^2$ were also produced in the same manner.

Two identical test bodies of each type were produced in each case. The results of the measurements represent the mean value of the measurements on the two identical test pieces.

Measurement Method

The combined tension and shear resistance of different test pieces was measured in accordance with ISO 527-4/EN 2561 at a measurement speed of 2 mm/min at 23° C. and a relative air humidity of 50%.

The combined tension and shear resistance of the adhesive bond was tested by the loop formed by the SikaWrap-300C NW woven fabric being placed around a steel tube connected to the movable frame of the test machine. The concrete cube was connected to the fixed frame of the test machine via a steel tie-bar placed thereon and threaded rods.

Results

| Bore | Grooves (number) | Material of fiber bundles | Maximum load (kN) | Mean value (kN) |
|---|---|---|---|---|
| No | None | — | 36.1 | 37.1 |
| | | | 40.3 | |
| | | | 34.9 | |
| Yes | None | Carbon fibers | 47.6 | 44.6 |
| | | | 39.0 | |
| | | | 47.2 | |
| Yes | None | Glass fibers | 54.9 | 52.6 |
| | | | 50.6 | |
| | | | 52.2 | |
| Yes | 8 | Carbon fibers | 61.9 | 64.3 |
| | | | 66.8 | |
| | | | 64.3 | |
| Yes | 8 | Glass fibers | 70.9 | 63.8 |
| | | | 56.8 | |
| | | | 63.7 | |

LIST OF REFERENCE NUMBERS

1 Supporting structure
2 Faces (2*a*, 2*b*, 2*c*)
3 Bore (3*a*, 3*b*, 3*c*)
4 Fiber bundle or fiber strands
5 Groove
6 Lamella
7 Woven fabric
8 Edge
9 Rounded portion
10 Concrete slab
11 Reinforcing rib
12 Adhesive

The invention claimed is:

1. An arrangement comprising:

a supporting structure with a surface consisting of one or more faces, wherein a bore extends from at least one of the faces into an inner region of the supporting structure, a fiber bundle partially in said bore, and said bore is filled with an adhesive, a portion of the fiber bundle projecting beyond said bore, wherein, on the at least one of the faces from which the bore extends into an inner region of the supporting structure, the supporting structure is provided with at least one groove which extends from the bore in at least one direction on the surface, and the projecting portion of the fiber bundle is at least partially located in the at least one groove and is fastened therein with adhesive, wherein, on the at least one of the faces, the at least one groove includes a plurality of grooves of the supporting structure, the plurality of grooves extending from the bore in a region of at least one circular sector, and the projecting portion of the fiber bundle, divided up according to the fiber strands, is located in the grooves and is fastened therein with adhesive.

2. The arrangement as claimed in claim 1, wherein the plurality of grooves includes 2 to 16 grooves which extends from the bore.

3. The arrangement as claimed in claim 1, wherein the at least one circular sector has a center point angle of 60° to 360°.

4. The arrangement as claimed in claim 1, wherein the bore is a first bore, and a second bore extends from the at least one of the faces of the surface of the supporting structure or from another one of the faces of the surface of the supporting structure, the another one of the faces facing away from the at least one of the faces from which the first bore extends into the inner region of the supporting structure, into the inner region of the supporting structure, and the at least one groove extends from an inlet location of the first bore along the surface of the supporting structure toward an inlet location of the second bore, and the projecting portion of the fiber bundle at least partially extends in the at least one groove and leads into the second bore and is fastened therein with adhesive.

5. The arrangement as claimed in claim 4, wherein the second bore extends from the another one of the faces of the surface of the supporting structure into the inner region of the supporting structure, and the first and second bores are connected to each other in an extension of respective axes of the first and second bores.

6. The arrangement as claimed in claim 1, wherein the at least one groove extends over at least one edge which connects two of the faces of the surface of the supporting structure to each other, and said at least one edge has a rounded portion in an interior of the at least one groove.

7. The arrangement as claimed in claim 1, wherein the surface of the supporting structure is at least partially connected to at least one surface reinforcement configured as a lamella and/or to at least one woven fabric, wherein the surface reinforcement is adhesively bonded to the surface of the supporting structure at least in a region of the portion of the fiber bundle which has been fastened in the at the least one groove by adhesive.

8. A method for reinforcing a supporting structure with a surface consisting of one or more faces, comprising:

providing at least one bore from one of the faces of the supporting structure into an inner region of the supporting structure, providing at least one groove from the at least one bore in at least one direction on the surface of the supporting structure, placing an adhesive into the at least one bore, introducing a fiber bundle into the at least one bore such that a portion of the fiber bundle projects beyond the at least one bore, at least partially inserting the projecting portion of the fiber bundle into the at least one groove, and fastening the projecting portion of the fiber bundle in the at least one groove by adhesive, wherein the at least one groove includes 2 to 16 grooves which extends from the at least one bore.

9. The method as claimed in claim 8, including impregnating the fiber bundle with a resin before introducing the fiber bundle into the at least one bore and inserting the fiber bundle into the at least one groove.

10. The method as claimed in claim 8, wherein a surface reinforcement, configured as a lamella or a woven fabric, is attached over the portion of the fiber bundle which has been fastened in the at least one groove by adhesive and is adhesively bonded to the surface of the supporting structure at least in a region of the portion of the fiber bundle which has been fastened in the at least one groove by adhesive.

11. The arrangement as claimed in claim 10, wherein the at least one groove extends from the at least one bore in a region of at least one circular sector having a center point angle of 60° to 360°.

12. The arrangement as claimed in claim 11, wherein the at least one groove extends over at least one edge which connects two of the faces of the surface of the supporting structure to each other, and said at least one edge has a rounded portion in an interior of the at least one groove.

13. The arrangement as claimed in claim 12, wherein the surface of the supporting structure is at least partially connected to at least one surface reinforcement configured as a lamella and/or to at least one woven fabric, wherein the surface reinforcement is adhesively bonded to the surface of the supporting structure at least in a region of the portion of the fiber bundle which has been fastened in the at least one groove by adhesive.

14. The method as claimed in claim 9, wherein a surface reinforcement, configured as a lamella or a woven fabric, is attached over the portion of the fiber bundle which has been fastened in the at least one groove by adhesive and is adhesively bonded to the surface of the supporting structure at least in a region of the portion of the fiber bundle which has been fastened in the at least one groove by adhesive.

15. An arrangement comprising:

a supporting structure with a surface consisting of one or more faces, wherein a first bore extends from at least one of the faces into an inner region of the supporting structure, a fiber bundle partially in said first bore, and said first bore is filled with an adhesive, a portion of the fiber bundle projecting beyond said first bore, wherein, on the at least one of the faces from which the first bore extends into the inner region of the supporting structure, the supporting structure is provided with at least one groove which extends from the first bore in at least one direction on the surface, and the projecting portion of the fiber bundle is at least partially located in the at least one groove and is fastened therein with adhesive, wherein a second bore extends from another one of the faces of the surface of the supporting structure into the inner region of the supporting structure, the another one of the faces facing away from the at least one of the faces from which the first bore extends into the inner region of the supporting structure, the at least one groove extends from an inlet location of the first bore along the surface of the supporting structure toward an inlet location of the second bore, and the projecting portion of the fiber bundle at least partially extends in the at least one groove and leads into the second bore and is fastened therein with adhesive, and the first and second bores are connected to each other in an extension of respective axes of the first and second bores, and wherein the fiber bundle extends from a first end to a second end, the first and second ends overlap, and the fiber bundle forms a closed loop.

16. The arrangement as claimed in claim 15, wherein the first and second ends overlap inside the first bore and/or the second bore.

17. The arrangement as claimed in claim 15, wherein the first and second ends overlap in the at least one groove.

18. The arrangement as claimed in claim 15, wherein the first and second ends overlap over a length of 5 cm to 50 cm.

19. The arrangement as claimed in claim 15, wherein the fiber bundle is wound around the supporting structure and overlaps with itself over and entire length of the fiber bundle.

* * * * *